US005475897A

United States Patent [19]

Satoh et al.

[11] Patent Number: 5,475,897

[45] Date of Patent: Dec. 19, 1995

[54] CAR DOOR HINGE

[75] Inventors: Motoyuki Satoh, Ichihara; Katsuo Suzuki, Tokyo; Kouichi Kato, Sakura; Tomoyuki Asari, Okazaki, all of Japan

[73] Assignee: Mitsubishi Steel Mfg. Co., Ltd., Tokyo, Japan

[21] Appl. No.: 153,292

[22] Filed: Nov. 16, 1993

[30] Foreign Application Priority Data

Dec. 11, 1992 [JP] Japan ..... 4-085327 U

[51] Int. Cl.[6] ..... E05F 1/14

[52] U.S. Cl. ..... 16/291

[58] Field of Search ..... 16/291, 292, 280, 16/286, 321, 323

[56] References Cited

U.S. PATENT DOCUMENTS

| | | | |
|---|---|---|---|
| 577,593 | 2/1897 | Bronson . | |
| 3,351,976 | 11/1967 | Gionet | 16/323 |
| 4,731,904 | 3/1988 | Sprague | 16/291 |
| 4,971,382 | 11/1990 | Ohno | 16/291 |

FOREIGN PATENT DOCUMENTS

| | | | |
|---|---|---|---|
| 515616 | 2/1992 | European Pat. Off. . | |
| 1503724 | 12/1967 | France . | |
| 931710 | 8/1955 | Germany | 16/190 |
| 56-47169 | 4/1981 | Japan . | |
| 892370 | 3/1962 | United Kingdom . | |
| 2199888 | 7/1988 | United Kingdom . | |

*Primary Examiner*—P. Austin Bradley
*Assistant Examiner*—Chuck Y. Mah
*Attorney, Agent, or Firm*—Flynn, Thiel, Boutell & Tanis

[57] ABSTRACT

A car door hinge comprises a rotating member 2 hinged on a fixed member I by means of a hinge pin 3. One end 5 of a wire spring 4 is attached to a point on the rotating member 2 distant from the hinge pin, and the other end 8 of the wire spring 4 is attached to a point on the fixed member 1 inside a sector of a circle defined by the hinge pin 3 and an arc subtended at the hinge pin 3 which is described by the end 5 as the rotating member rotates. A spring restoring force therefore acts during the opening and closing of the door so that the door always opens and closes properly. Moreover, the spring occupies a minimum of space, and the rotation of the door is stopped at a predetermined angle.

2 Claims, 5 Drawing Sheets

CAR DOOR HINGE

BACKGROUND OF THE INVENTION

1. Field of the Invention

This invention relates to a car door hinge for fitting a car front door, rear door and luggage compartment door.

2. Description of the Prior Art

A conventional door hinge is known in the art which is provided with a small elastic strip having undulations in its surface and a door checker consisting of a ball rolling on the surface of the strip so as to engage with grooves on the strip, thereby shopping the rotation of the door at a predetermined angle.

In another conventional car luggage compartment door hinge, one end of a tensile coiled spring engages with a rotating member of a luggage compartment door hinge, the other end of the tensile coiled spring engaging with the fixed member of the luggage compartment door hinge at a position distant from the rotation center of the hinge so that the luggage compartment door can be easily opened and closed by the tensile force of the coiled spring.

In hinges which are fitted with a checker, however, no restoring force was applied to the opening and closing motion of the door, so the door tended not to open and close properly. On the other hand, in hinges fitted with a torsion bar spring, the torsion bar spring was too long so that luggage space was reduced.

Further, in hinges using a tensile coiled spring, the hinge was so large that luggage space was again reduced.

SUMMARY OF THE INVENTION

This invention provides a car door hinge which aims to overcome the aforesaid disadvantages. By applying a spring restoring force to the opening and closing of the door, it ensures that the door always opens and closes properly. Moreover, the spring occupies minimum space, and the rotation of the door stops at a predetermined angle. Further, the problem of reduction of luggage space in the prior art is resolved without any loss of ease in opening and closing the luggage compartment door.

The car door hinge of this invention is therefore characterized in that a rotating member is hinged to a fixed member by means of a hinge pin, a first end of a wire spring being attached to a point on the rotating member distant from the hinge pin, and the other end of the spring being attached to a point on the fixed member inside a sector of a circle defined by the hinge pin and an arc subtended at the hinge pin which is described by the first end of the spring as the rotating member rotates so that the spring is compressed. This car door hinge is further characterized in that a rotating member is hinged to a fixed member by a hinge pin, the first ends of each of a plurality of wire springs being individually attached to a plurality of points on the rotating member at the same radius from the hinge pin, and the other ends of the springs being individually attached to a plurality of points on the fixed member inside a sector of a circle defined by the hinge pin and an arc subtended at the hinge pin which is described by the first ends of the springs as the rotating member rotates so that the springs are compressed.

The word "door" as used in the context of this invention shall be understood to mean a front door, rear door or luggage compartment door.

A first end of each wire spring rotates about the hinge pin as center, while the other end is attached to a point on the fixed member. When the first end of the spring moves beyond a line connecting the other end and the center of the hinge pin, the spring generates a restoring force which tends to rotate the door.

DETAILED DESCRIPTION OF THE PREFERRED EMBODIMENTS

One embodiment of this invention will now be described in the case of a front door and rear door.

Figure 1:
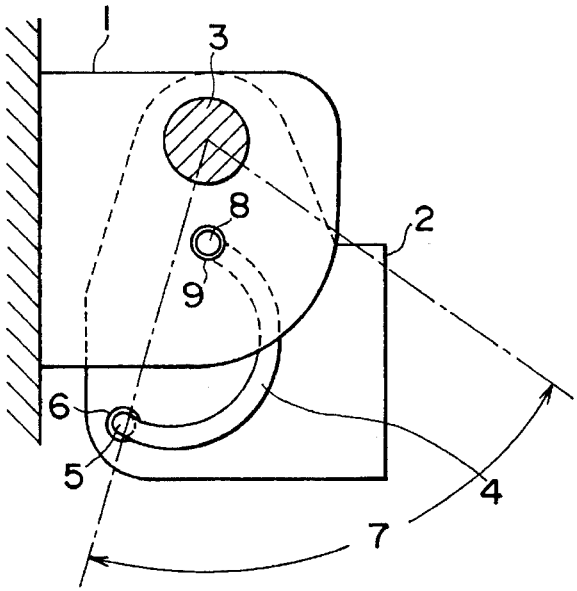
FIG. 1 is a plan view of one embodiment of the first invention.

FIG. 1 is a plan view of this embodiment of the invention.

Figure 2:
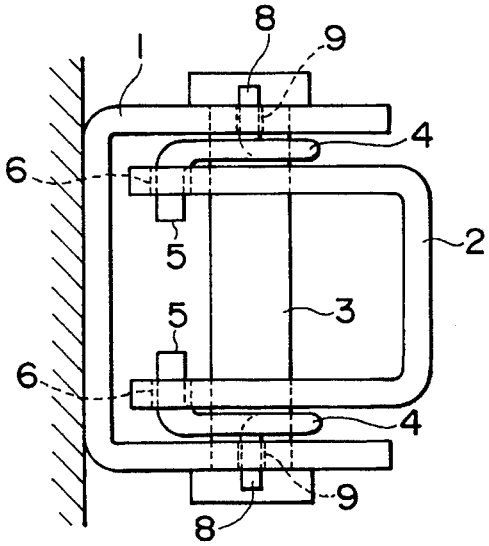
FIG. 2 is a front view of FIG. 1.
Figure 3:
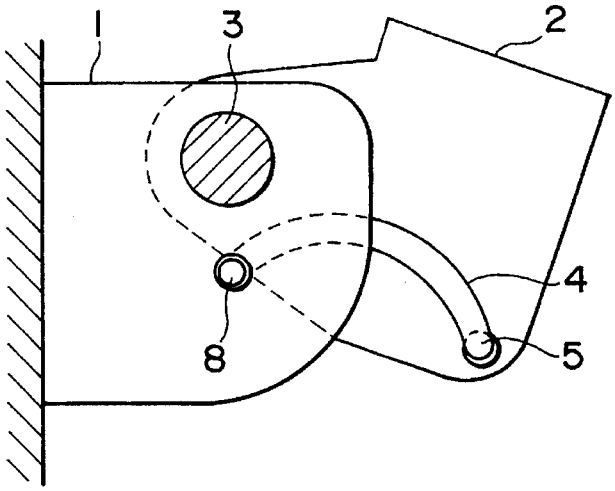
FIG. 3 is a plan view showing the embodiment of the first invention in a different position to that shown in FIG. 1.

FIG. 2 is a front view of FIG. 1. In FIG. 2, 1 is a fixed member formed in the shape of a rectangle having one side missing, this member being attached to the chassis of the car. 2 is a rotating member formed in the shape of a rectangle with one side missing, this member being attached to the door, and the rotating member 2 is hinged on the fixed member 1 by means of a hinge pin 3 which passes vertically through both members. FIG. 1 shows the case where the door is closed. When the door is opened, the rotating member 2 rotates in an anticlockwise direction around the hinge pin 3 as center, and when the door is fully open, the assembly is in the position shown in FIG. 3.

Wire springs 4 bent into a semicircular arc of similar shape are respectively inserted in the space between the upper surface of the rotating member 2 and the fixed member 1, and the space between the lower surface of the rotating member 2 and the fixed member 1. One end 5 of each of the wire springs 4 is bent towards the rotating member 2, these ends being respectively pressed into fixing holes 6 drilled at points in the member 2 lying in a vertical line so as to attach them to the member 2. When the door is fully opened and the member 2 rotates together with the door as described hereintofore, the holes 6 and the ends 5 of the wire springs 4 are displaced through a rotation arc 7 having the hinge pin 3 as center.

The other end 8 of each of the wire springs 4 is bent toward the fixed member 1, these ends being respectively pressed into fixing holes 9 drilled in the member 1 in a vertical line inside the aforesaid rotation arc 7 subtended at the hinge pin 3 so as to attach them to the member 1. These fixing holes 9 drilled in the member 1 do not change their position even when the member 2 rotates together with the door.

According to this construction the springs 4, whereof the ends 5 are pressed into the fixing holes 6 of the rotating member 2 and the other ends 8 are pressed in the fixing holes 9 of the fixed member 1, are bent so as to bring their ends 5 closer to their ends 8 and thereby compress the springs.

Figure 4:
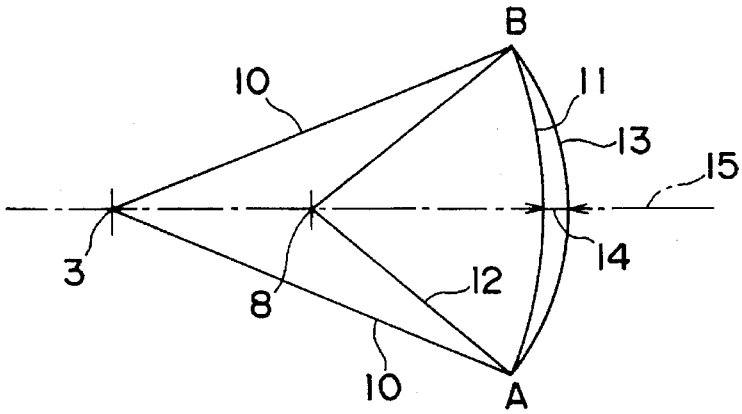
FIG. 4 is a drawing showing the action of the wire spring of the first invention.

Next, an embodiment of this invention will be described with reference to the drawing of FIG. 4 which illustrates the action of this hinge assembly.

Figure 5:
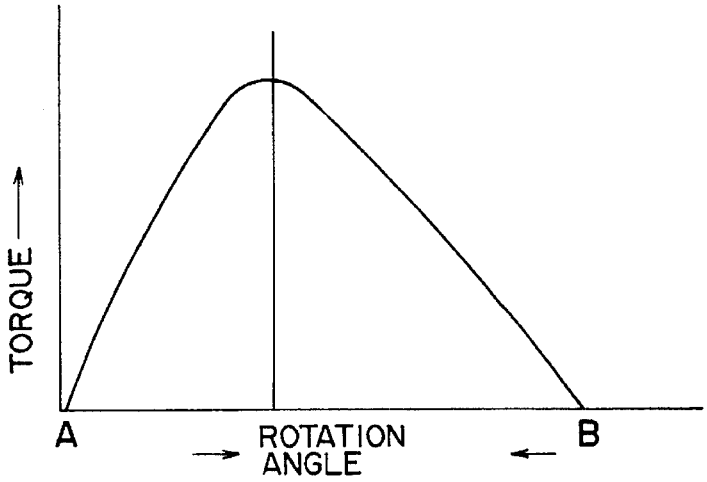
FIG. 5 is a graph showing the torque of the wire spring of the first invention.

Let the position of the end 5 of one of the wire springs 4 when the door is closed as shown in FIG. 1, be A, and the position of this end 5 when the door is open as shown in FIG. 2, be B. When the rotating member 2 rotates about the hinge pin 3 as center, this end 5 is displaced along an arc 11 of radius 10, this radius 10 being the distance from the hinge pin 3 to the point A. The spring 4 is therefore compressed by a compression amount 14 equal to the difference in the positions of the arc 11 and an arc 13 of radius 12 subtended at its other end 8 as fixed point, this radius 12 being the distance from the end 8 to the point A. As a result, a torque acts on the rotating member 2 as shown in FIG. 5.

When the end 5 is on the side of the point A with respect to a straight line 15 connecting the hinge pin 3 and the other end 8 as fixed point, the aforesaid torque acts on the rotating member 2 in such a direction as to close the door, whereas when the end 5 is nearer the point B with respect to the straight line 15, the aforesaid torque acts on the rotating member 2 in such a direction as to open the door. As a result, the torque of the spring 4 assists the latter part of the operation of closing the door, and also the latter part of the operation of opening the door, thereby reducing the manual force which is necessary to accomplish each of these operations.

Figure 6:
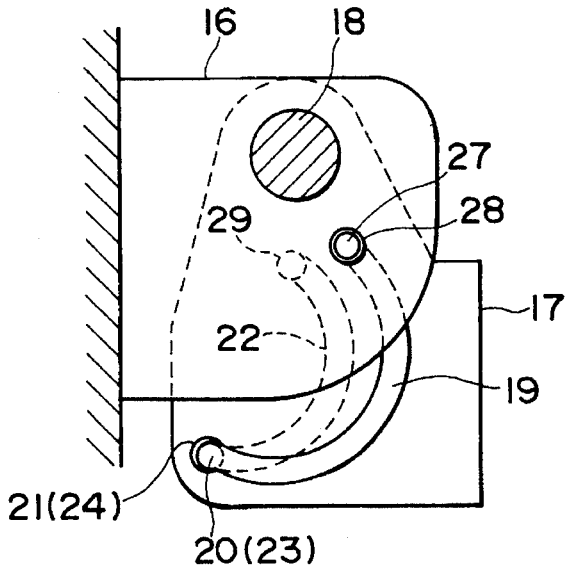
FIG. 6 is a plan view of one embodiment of the second invention.
Figure 7:
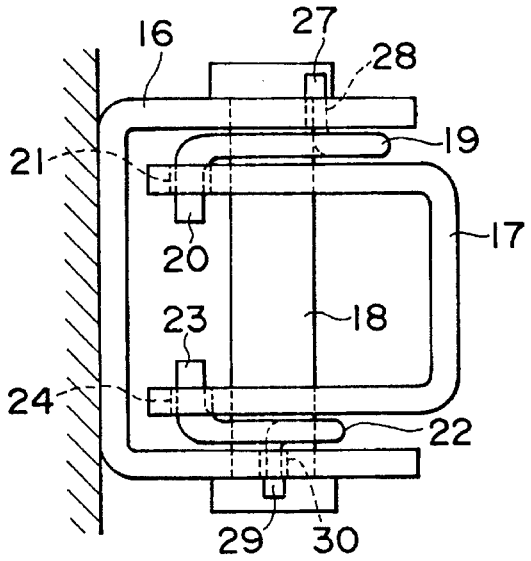
FIG. 7 is a front view of FIG. 6.
Figure 8:
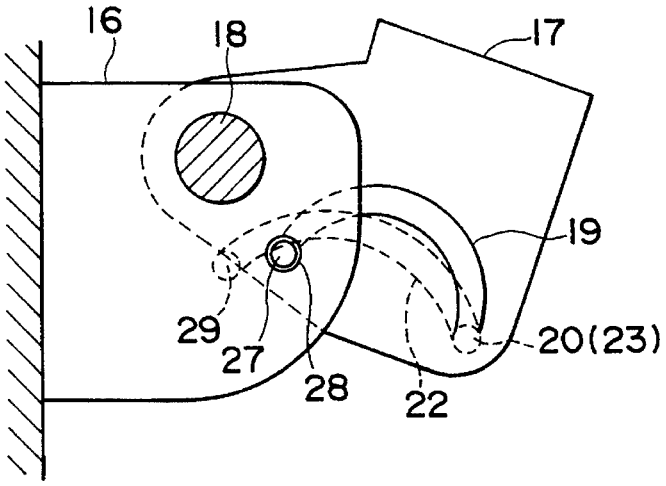
FIG. 8 is a plan view showing the embodiment of the second invention in a different position to that shown in FIG. 6.

FIG. 6 is a plan view of an embodiment of the second invention, and FIG. 7 is a front view of FIG. 6. 16 is a fixed member formed in the shape of a rectangle having one side missing, this member being attached to the chassis of the car. 17 is a rotating member formed in the shape of a rectangle with one side missing, this member being attached to the door, and the rotating member 17 is hinged on the fixed member 16 by means of a hinge pin 18 which passes vertically through both members. FIG. 6 shows the case where the door is closed. When the door is opened, the rotating member 17 rotates in an anticlockwise direction around the hinge pin 18 as center, and when the door is fully open, the assembly is in the position shown in FIG. 8.

A wire spring 19 bent into a semicircular arc is inserted in the space between the upper surface of the rotating member 17 and the fixed member 16. One end 23 (FIG. 7) of the wire spring 22 is bent towards the rotating member 17, this end being pressed into a fixing hole 24 drilled in the member 17. In the example shown in FIG. 6 and FIG. 7, an upper fixing hole 21 and the lower fixing hole 24 are drilled in the same vertical line. However, it is not indispensable that they are in the same vertical line provided that they are drilled in the rotating member 17 at equal distances from the center of the hinge pin 18.

Figure 9:
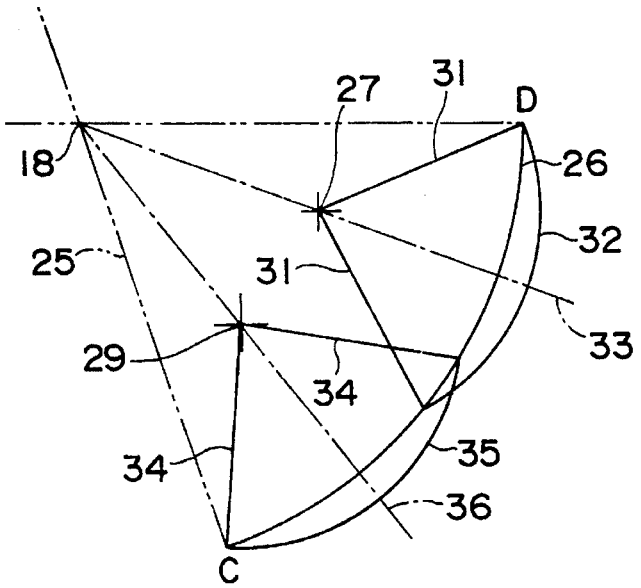
FIG. 9 is a drawing showing how the wire spring of the second invention works.

In FIG. 9, to which reference is hereinafter made for the purpose of describing the action of this assembly, let C be the position of the end 20 of the spring 19 and the end 23 of the spring 22 when the door is closed. When the door is fully opened and the rotating member 17 rotates together with the door, the end 20 of the spring 19 and the end 23 of the spring 22 move from the point C to the point D along an arc 26 of radius 25 subtended at the hinge pin 18, this radius 25 being the distance from the hinge pin 18 to the point C. The sector defined by the points C, D and the center of the hinge pin 18 is the range of rotation of the end 20 of the spring 19 and the end 23 of the spring 22.

As shown in FIG. 7, the other end 27 of the spring 19 is bent toward the fixed member 16, this end 27 being pressed into a fixing hole 28 drilled in the fixed member 16 at a point near the point D (FIG. 9) inside the aforesaid rotation sector so as to attach it to the fixed member 16. The other end of the other spring 22 is also bent toward the fixed member 16, this end being pressed into a fixing hole 30 drilled in the fixing member 16 near the point C inside the aforesaid rotation sector so as to attach it to the fixing member 16. Even when the rotating member 17 rotates together with the door, the positions of the fixing holes 28, 30 drilled in the fixed member 16 do not move, and the springs 19, 22 are therefore kept in a compressed state.

Next, the action of the aforesaid embodiment of the invention will be described. When the rotating member 17 rotates about the hinge pin 18 as center, the end 20 of the spring. 19 and the end 23 of the spring 22 are displaced along the arc 26 in FIG. 9. The spring 19 is therefore compressed by a compression amount equal to the difference in the positions of the arc 26 and an arc 32 of radius 31 subtended at its other end 27 as fixed point, this radius 31 being the distance from the end 27 to the point D. As a result, a torque acts on the rotating member 17. When the end 20 is on the side of the point D with respect to a straight line 33 connecting the hinge pin 18 and the other end 27, the aforesaid torque acts on the rotating member 17 in such a direction as to open the door, whereas when the end 20 is nearer the point C with respect to the straight line 33, the aforesaid torque acts on the rotating member 17 in such a direction as to close the door.

The other spring 22 is compressed by a compression amount equal to the difference in the positions of the arc 26 and an arc 35 of radius 34 subtended at its other end 29 as fixed point, this radius 34 being the distance from the end 29 to the point C. This also causes a torque to act on the rotating member 17. When the end 23 is on the side of the point D with respect to a straight line 36 connecting the hinge pin 18 and the other end 29, the aforesaid torque acts on the rotating member 17 in such a direction as to open the door, whereas when the end 23 is nearer the point C with respect to the straight line 36, the aforesaid torque acts on the rotating member 17 in such a direction as to close the door.

Figure 10:
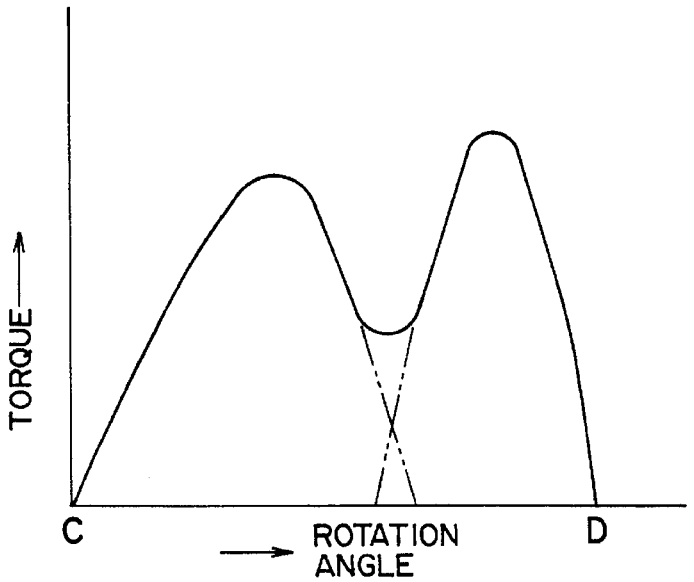
FIG. 10 is a graph showing the torque of the wire spring of the second invention.

FIG. 10 is a graph showing the case when a force generated by a plurality of wire springs acts on the rotating member 17. In this case, torque peaks are obtained at a plurality of positions.

According to this invention, therefore, a spring restoring force is applied by wire springs which occupy a minimum of space to the opening and closing motion of a door. The opening and closing of the door can therefore be accomplished with a small force.

Further, torque peaks may be obtained at a plurality of door opening or closing positions by using a plurality of wire springs, and the rotation of the door may be stopped at a predetermined angle.

What is claimed is:

1. A car door hinge characterized in that a rotating member is hingedly connected to and rotating about a fixed member by means of a hinge pin, a first end of a wire spring being attached to a point on said rotating member distal to said hinge pin, and a second end of said spring being attached to said fixed member at a point on said fixed member proximal to said hinge pin and within a sector of a circle defined by an arc centered at said hinge pin and circumscribed by the rotation of said spring first end, wherein said spring is compressed as said rotating member rotates.

2. A car door hinge characterized in that a rotating member is hingedly connected to and rotating about a fixed member by means of a hinge pin, a first end of each of a plurality of wire springs being individually attached to a plurality of points on said rotating member distal to and at an equal radius from said hinge pin, and a second end of each of said springs being individually attached to a plurality of points on said fixed member proximal to said hinge pin and within a sector of a circle defined by an arc centered at said hinge pin and circumscribed by the rotation of each of said springs first end, wherein said springs are compressed as said rotating member rotates.

* * * * *